US005581888A

United States Patent [19]

Lewis

[11] Patent Number: 5,581,888

[45] Date of Patent: Dec. 10, 1996

[54] LUBRICATED BLADE PIVOT FOR FOLDING KNIVES

[76] Inventor: Ted W. Lewis, P. O. Box 1478, San Bernardino, Calif. 92402

[21] Appl. No.: 399,688

[22] Filed: Mar. 7, 1995

[51] Int. Cl.[6] ..... B26B 3/00

[52] U.S. Cl. ..... 30/123.3; 30/155; 403/38

[58] Field of Search ..... 30/123, 123.3, 30/155, 156, 157, 161; 403/38, 39

[56] References Cited

U.S. PATENT DOCUMENTS

| | | | |
|---|---|---|---|
| 1,640,635 | 8/1927 | Atkins | 30/123.3 |
| 1,886,272 | 11/1932 | Thomson | 403/38 |
| 2,441,552 | 5/1948 | Barnes | 403/38 |
| 2,707,645 | 5/1995 | Moskovitz | 403/38 |
| 4,669,188 | 6/1987 | Evrell | 30/155 |
| 4,947,552 | 8/1990 | Barnes | 30/161 |
| 5,327,651 | 7/1994 | Favreau | 30/161 |

*Primary Examiner*—Hwei-Siu Payer
*Attorney, Agent, or Firm*—Norman E. Brunell

[57] ABSTRACT

A folding knife includes a lubricated barrel pivot removably mounted in the handle. An oil reservoir within the barrel communicates with the bearing surface by means of an oil wick in a bore. The barrel may be mounted in the handle by engaging male threads at one end of the barrel into female threads in the knife handle in which case an oil conduit is provided within the male threads for filling the oil chamber. Similarly, the barrel may be mounted with a pair of screws engaged with female threads at opposite ends of the barrel in which case an oil conduit is provided within at least one of the female threads for filling the oil chamber. Further, the barrel may be mounted by providing a slotted head at one of the barrel and female threads at the other end. A screw is mounted through the handle to engage the female threads and an oil conduit is provided within the female threads for filling the chamber with oil.

18 Claims, 2 Drawing Sheets

LUBRICATED BLADE PIVOT FOR FOLDING KNIVES

BACKGROUND OF THE INVENTION

1. Field of the Invention

This invention relates to folding knives and in particular to blade pivot systems used for folding knives.

2. Description of the Prior Art

Conventional folding knives use a soft metal rivet secured in the bolster and extending through a hole in the blade. Such conventional folding knives suffer from many disadvantages. Because a soft rivet is used, the tolerance between the rivet outside diameter (O.D.) and the inner diameter (I.D.) of the holes through the bolster and blade is relatively large. Contaminants and grit collect in this area which is used, in operation of the knife, as a bearing surface. In addition, rivets are difficult if not impossible to conveniently remove and replace. Folding knives with conventional soft rivets are, therefore, as a practical matter usually unrepairable. The cost and difficulty in removing and replacing rivets make blade replacement impossible for the casual user.

What is needed is an improved blade pivot system for folding knives which overcomes the limitations of conventional systems and provides a durable, contamination resistant pivot that permits the easy and convenient repair of folding knives and replacement of blades. A means of constant and reliable lubrication during service would also be desirable.

SUMMARY OF THE INVENTION

The present invention overcomes the limitations of conventional folding knife blade design by providing a pivot system using a threaded pivot including an oil reservoir supplying a wick leading to the bearing surfaces. A set screw is optionally provided to prevent rotation of the threaded pivot during operation, that is opening and closing, of the folding knife.

In a first aspect, the present invention provides a folding knife having a knife handle, a knife blade, and a barrel pivot for mounting the knife blade to the knife handle for rotation. An oil chamber communicating with the bearing surface of the barrel along a wick is provided for lubricating the pivot. The barrel is mounted in the handle by engaging male threads at one end of the barrel into female threads in the knife handle. An oil conduit is provided within the male threads for filling the oil chamber.

In another aspect, the present invention provides a pair of screws engaged with female threads at opposite ends of the barrel. An oil conduit is provided within at least one of the female threads for filling the oil chamber.

In still another aspect, the present invention provides a slotted head at one of the barrel and female threads at the other end. A screw is mounted through the handle to engage the female threads. An oil conduit is provided within the female threads for filling the chamber with oil.

These and other features and advantages of this invention will become further apparent from the detailed description and accompanying figures that follow. In the figures and description, numerals indicate the various features of the invention, like numerals referring to like features throughout both the drawings and the description.

DETAILED DESCRIPTION OF THE PREFERRED EMBODIMENT(s)

Figure 1:
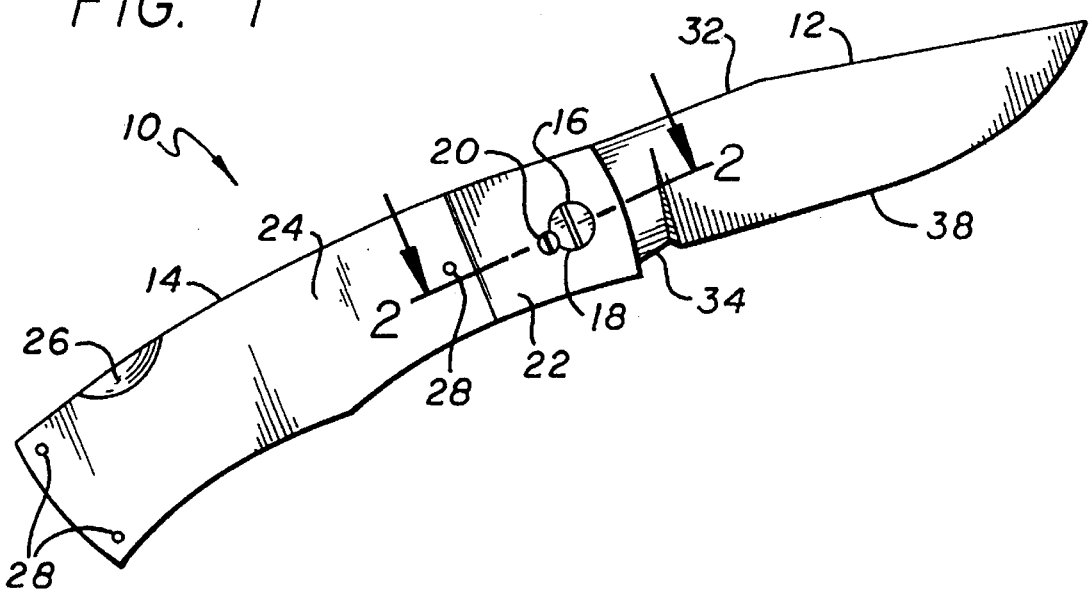
FIG. 1 is a top plan view of a folding knife according to the present invention.

FIG. 1 is a top plan view of folding knife 10 according to the present invention, showing blade 12 in the extended or open position. Blade 12 is mounted to handle 14 by means of threaded pivot 16. Slotted head 18 is held by set screw 20 to prevent rotation during opening and closing of folding knife 10. Except for set screw 20, folding knife 10 appears the same as a conventional folding knife. For convenience in disclosing the present invention, a particular type of locking blade folding knife is shown, but the present invention works equally well with many if not all other types of folding knives.

Folding knife 10 shown in FIG. 1 includes bolster 22, scale 24 and locking lever 26 within handle 14. Scale 24 is secured to handle 14 by means of rivets 28 while bolster 22 is secured to handle 14 by threaded pivot 16. Alternatively, bolster 22 can be made integral with handle 14, or can be a separate piece soldered on the handle 14.

Similarly, a particular type of blade 12 is illustrated in FIG. 1, but the present invention is applicable to any type of blade used with a folding knife. Blade 12 includes sharpened edge 38, cut swedge 32 and blade tang 34 which extends into handle 14 and is held in a pivoting relationship therewith by threaded pivot 16.

Figure 2:
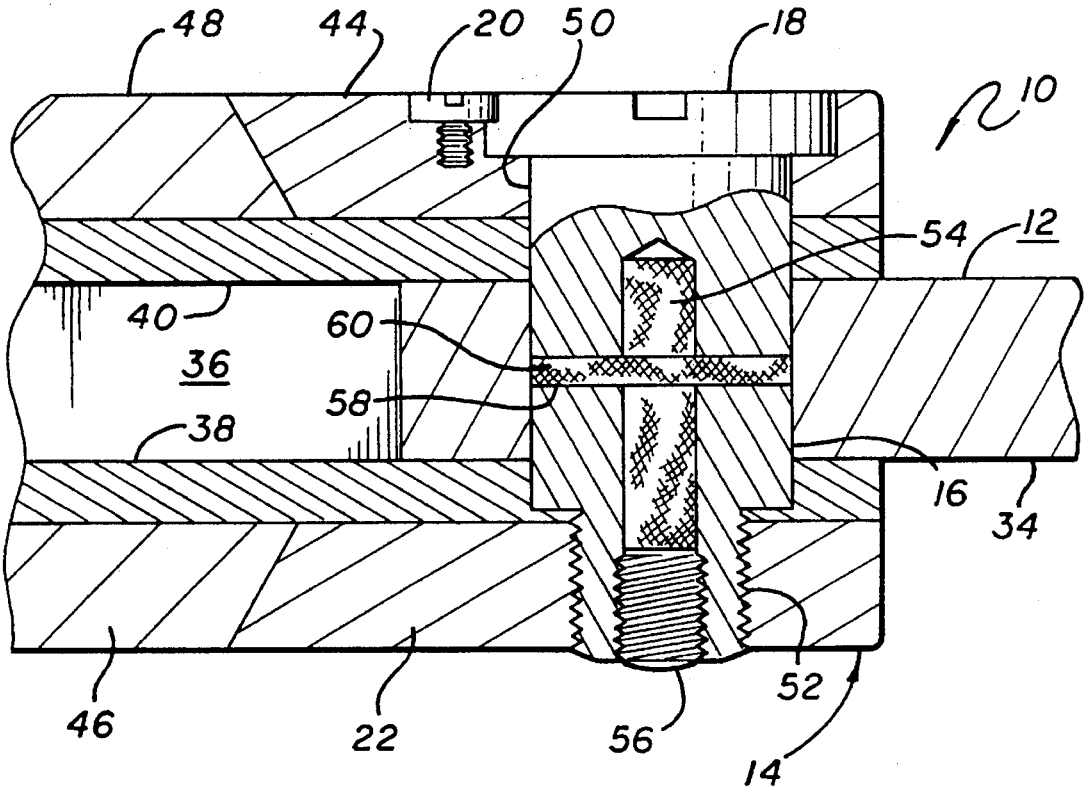
FIG. 2 is a cross sectional view of the folding knife of FIG. 1 taken along line 2—2.

FIG. 2 is a cross sectional view of folding knife 10 of FIG. 1 taken along line 2—2. Blade tang 34 of blade 12 includes a hole therethrough in which threaded pivot 16 is positioned. Handle 14 includes blade slot 36 in which blade 12 resides when folding knife 10 is closed. Blade slot 36 is surrounded by liners 38 and 40 on opposing sides and by lock spring which may be part of or associated with locking lever 26. In a conventional manner, blade 12 may be locked in the open position by the spring action of lock spring against blade tang 34 and released for closing by operation of locking lever 26. Similarly, bolsters 22 and 44 are secured against liners 38 and 40, respectively, as are scales 46 and 48.

In accordance with one embodiment of the present invention, threaded pivot 16 is in the form of a hollow screw including slotted head 18 countersunk into bolster 44, barrel 50 positioned within the hole in blade 12 and threaded end 52 threadably engaged with matching threads in bolster 22.

Barrel 50 serves as the pivot bearing surface for rotation of blade 12. Set screw 20 intersects with a notched section at the top of set screw 20 to prevent any rotation of slotted head 18. Barrel 50 is hollow and includes chamber 54 containing a cotton-filled reservoir of lubricating oil, such as machine oil or gun oil. After the appropriate amount of oil has been stored in chamber 54, the open end of chamber 54 at threaded end 52 is sealed by the insertion of blind set screw 56.

Lateral bore 58 extends through barrel 50 penetrating chamber 54. Oil wick 60 is positioned within lateral bore 58 and provides a pathway for oil within chamber 54 to the outside bearing surfaces of barrel 50 surrounded by the periphery of the pivot hole through blade 12. Rotation of blade 12 about non-rotating barrel 50 is therefore lubricated by oil from chamber 54 which reaches blade 12 via oil wick 60.

Figure 3:
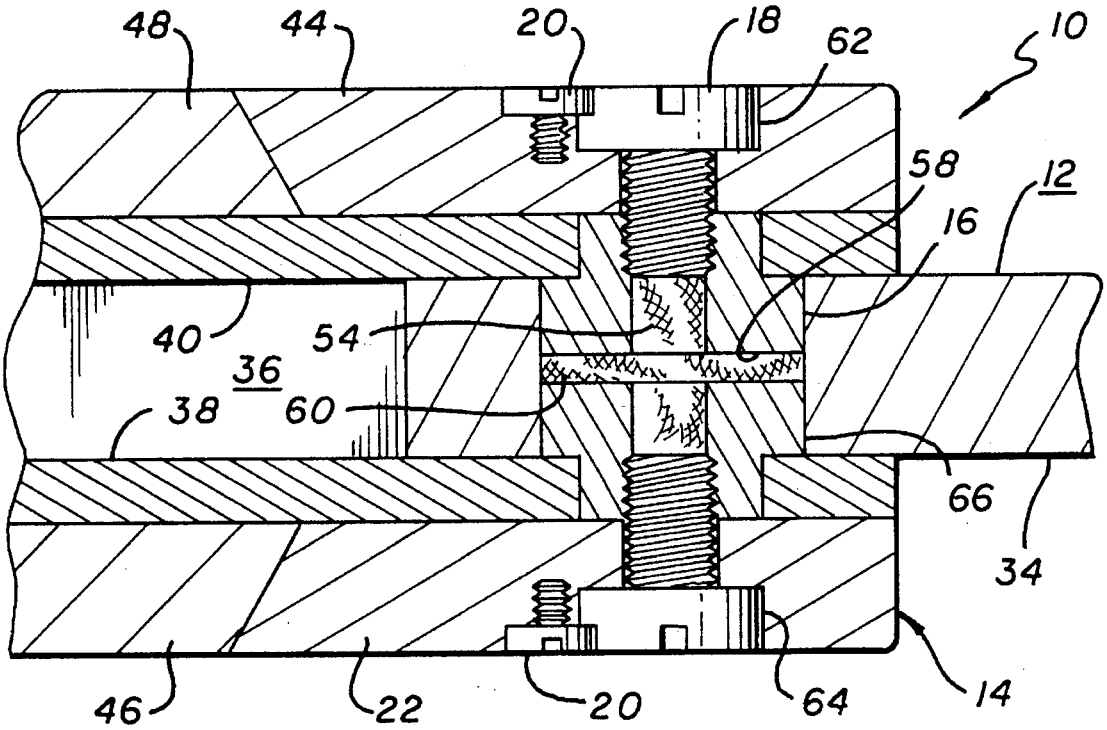
FIG. 3 is a cross sectional view of another embodiment of the folding knife of FIG. 1 taken along line 2—2.

A second embodiment of the present invention is shown in FIG. 3 in which threaded pivot 16 is configured from screws 62 and 64 inserted through unthreaded openings in bolsters 44 and 22, respectively, to threadably engage with opposite ends of barrel 66. In all other respects the embodiment of folding knife 10 shown is substantially the same as the embodiment of folding knife 10 shown in FIG. 2. A pair of set screws 20 prevent rotation of screws 62 and 64. Barrel 66 fits through the opening in blade tang 34 of blade 12 to serve as a pivot therefore. Barrel 66 includes oil reservoir chamber 54 providing lubrication to the pivoting surfaces of barrel 66 via oil wick 60 in lateral bore 58. Oil may be added to chamber 54 by removing set screw 20 and then screws 62 or 64.

Figure 4:
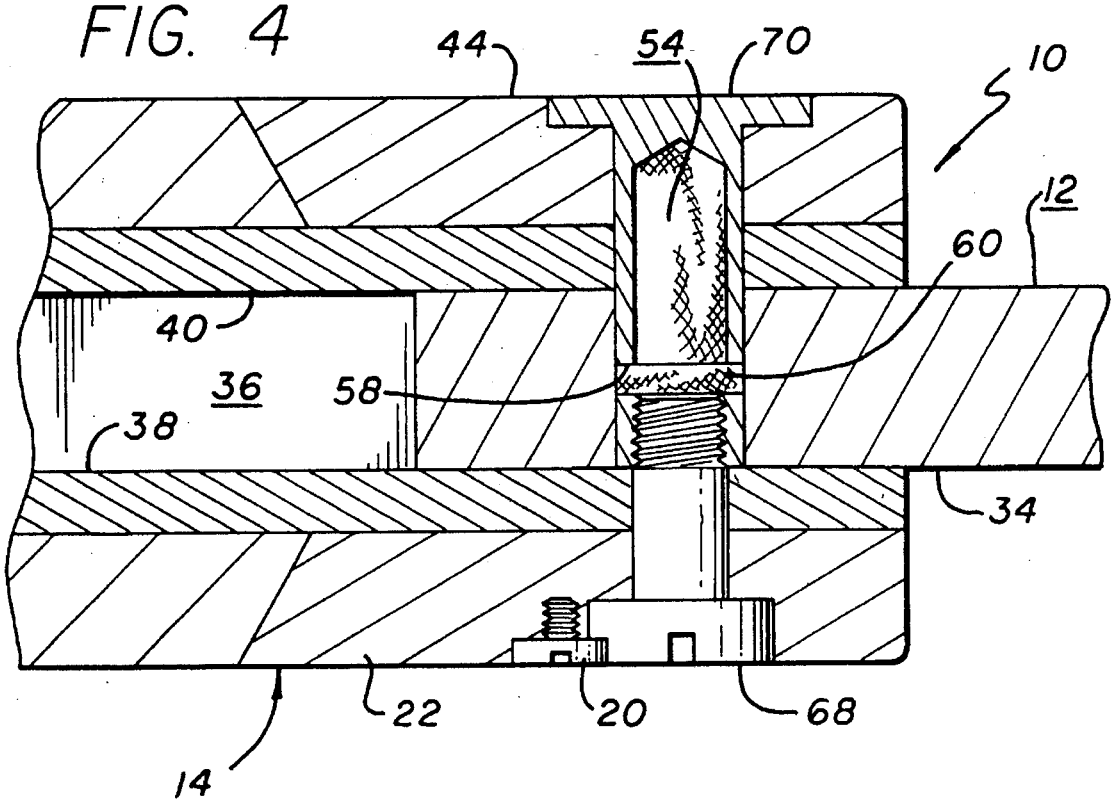
FIG. 4 is a cross sectional view of still another embodiment of the folding knife of FIG. 1 taken along line 2—2.

A third embodiment of the present invention is shown in FIG. 4 in which threaded pivot 16 includes screw 68, inserted through unthreaded holes in bolster 22 and liner 38 and secured by set screw 20, and threaded barrel 70. Threaded barrel 70 is inserted through an unthreaded hole in bolster 44 in which it may be countersunk and a connecting hole in liner 40 to reach the pivot opening in blade 12. Threaded barrel 70 is secured in handle 14 by being threadably engaged with screw 68. The bearing surface of threaded barrel 70 is lubricated by oil in reservoir chamber 54 conducted by oil wick 60 in lateral bore 58 to blade tang 34.

Having now described the invention in accordance with the requirements of the patent statutes, those skilled in this art will understand how to make changes and modifications in the present invention to meet their specific requirements or conditions. Such changes and modifications may be made without departing from the scope and spirit of the invention as set forth in the following claims.

What is claimed is:

1. A folding knife, comprising:

a knife handle;

a knife blade;

a pivot for mounting the knife blade to the knife handle for rotation; and means for lubricating the pivot, wherein the means for lubricating the pivot further comprises:

a bearing surface;

an oil reservoir chamber within the pivot; and lubricating means for lubricating the bearing surface from the oil reservoir.

2. The invention of claim 1, wherein the means for lubricating means further comprises:

a bore extending from the chamber to the bearing surface; and a wick positioned within the bore.

3. A folding knife, comprising:

a knife handle;

a knife blade;

a pivot for mounting the knife blade to the knife handle for rotation; and means for lubricating the pivot, wherein the pivot further comprises:

a barrel mounted in the knife handle through a hole in the knife blade;

a bearing surface around the exterior surface of the barrel;

an oil reservoir in the barrel; and lubricating means for lubricating the bearing surface from the oil reservoir.

4. The folding knife of claim 3, wherein the lubricating means further comprises:

a bore extending through the barrel; and a wick positioned within the bore.

5. The folding knife of claim 4, wherein the pivot further comprises:

threaded means for removably mounting the barrel in the knife handle.

6. The folding knife of claim 5, wherein the lubricating means further comprises:

a slotted head at one end of the barrel; and screw threads at the other end of the barrel mating with threads in the knife handle.

7. The folding knife of claim 6, wherein the threaded means further comprises:

removable means for restricting rotation of the slotted head.

8. The folding knife of claim 6, wherein the barrel further comprises:

an oil conduit extending from the reservoir through the screw threads to the exterior of the folding knife; and sealing means for sealing the conduit.

9. The folding knife of claim 8, wherein the sealing means further comprises:

a set screw inserted in an end of the conduit.

10. The folding knife of claim 8, wherein the sealing means further comprises:

a blind set screw inserted in an end of the conduit.

11. The folding knife of claim 5, wherein the threaded means further comprises:

a pair of threaded openings in opposite ends of the barrel; and a screw mating with each of said threaded openings to affix the barrel in the knife handle.

12. The folding knife of claim 11, further comprising:

set screws for preventing rotation of each said mating screw.

13. The folding knife of claim 12, wherein at least one of the threaded openings further comprises:

an oil conduit extending from the reservoir to the exterior of the folding knife; and sealing means for sealing the conduit.

14. The folding knife of claim 5, wherein the threaded means further comprises:

a threaded opening at one end of the barrel; and a screw mating with the threaded opening to affix the barrel in the knife handle.

15. The folding knife of claim 14, further comprising:

a set screw for preventing rotation of the mating screw.

16. The folding knife of claim 14, wherein the threaded opening further comprises:

an oil conduit extending from the reservoir to the exterior of the folding knife when the screw is removed.

17. A folding knife, comprising:

a knife handle;

a knife blade;

a removable, threaded pivot for mounting the knife blade to the knife handle for rotation;

means located within the removable, threaded pivot for lubricating the pivot; and set screw means for preventing undesired unthreading of the removable, threaded pivot from rotation of the knife blade with respect to the knife handle.

18. A folding knife, comprising:

a knife handle;

a knife blade;

a removable, threaded pivot for mounting the knife blade to the knife handle for rotation;

means located within the removable, threaded pivot for lubricating the pivot;

an oil reservoir chamber within the pivot; and wicking means for lubricating a bearing surface of the pivot from oil in the oil reservoir chamber.

* * * * *